US011581638B2

(12) United States Patent
Ai et al.

(10) Patent No.: US 11,581,638 B2
(45) Date of Patent: Feb. 14, 2023

(54) DUAL-BEAM ANTENNA ARRAY

(71) Applicant: CommScope Technologies LLC, Hickory, NC (US)

(72) Inventors: Xiangyang Ai, Plano, TX (US); Peter J. Bisiules, LaGrange Park, IL (US); Ligang Wu, Suzhou (CN); Kumara Swamy Kasani, Godavari Khani (IN)

(73) Assignee: CommScope Technologies LLC, Hickory, NC (US)

( * ) Notice: Subject to any disclaimer, the term of this patent is extended or adjusted under 35 U.S.C. 154(b) by 161 days.

(21) Appl. No.: 17/243,845

(22) Filed: Apr. 29, 2021

(65) Prior Publication Data

US 2021/0351505 A1 Nov. 11, 2021

(30) Foreign Application Priority Data

May 9, 2020 (CN) ..... 202010385103.X

(51) Int. Cl.

| | |
|---|---|
| ***H01Q 3/26*** | (2006.01) |
| ***H01Q 21/06*** | (2006.01) |
| ***H01Q 3/36*** | (2006.01) |
| ***H01Q 1/24*** | (2006.01) |

(52) U.S. Cl.

CPC ..... *H01Q 3/2617* (2013.01); *H01Q 1/243* (2013.01); *H01Q 3/36* (2013.01); *H01Q 21/064* (2013.01)

(58) Field of Classification Search

CPC .. H01Q 3/26; H01Q 1/24; H01Q 3/36; H01Q 21/06

USPC ..... 343/702

See application file for complete search history.

(56) References Cited

U.S. PATENT DOCUMENTS 9,831,548 B2 * 11/2017 Timofeev ..... H01Q 3/26
10,181,657 B2 * 1/2019 Ai ..... H01Q 21/061

* cited by examiner

*Primary Examiner* — Andrea Lindgren Baltzell
(74) *Attorney, Agent, or Firm* — Myers Bigel, P.A.

(57) ABSTRACT

In order to reduce large sidelobes that may result from using a base station antenna with increased electronic downtilt, base station antennas according to the present disclosure may have a plurality of modules in which the columns of radiating elements of at least one of the modules are staggered or offset with respect to each other. For example, a multi-beam cellular antenna may include an antenna array having a plurality of modules, each module comprising at least three columns of radiating elements each having first polarization radiators, wherein the columns of radiating elements of at least one of the modules are staggered with respect to each other; and an antenna feed network configured to couple at least a first input signal and a second input signal to each first polarization radiator of each of the radiating elements included in a first of the plurality of modules.

20 Claims, 11 Drawing Sheets

DUAL-BEAM ANTENNA ARRAY

CROSS-REFERENCE TO RELATED APPLICATION

The present application claims the benefit of priority to Chinese Patent Application 202010385103.X, filed on May 9, 2020, the disclosure of which is herein incorporated by reference in its entirety for all purposes.

TECHNICAL FIELD

The present invention generally relates to radio communications and, more particularly, to base station antennas for cellular communications systems.

BACKGROUND

Cellular communications systems are well known in the art. In a typical cellular communications system, a geographic area is divided into a series of regions that are referred to as "cells," and each cell is served by a base station. The base station may include baseband equipment, radios and base station antennas that are configured to provide two-way radio frequency ("RF") communications with subscribers that are positioned throughout the cell. In many cases, the cell may be divided into a plurality of "sectors," and separate base station antennas provide coverage to each of the sectors. The antennas are often mounted on a tower, with the radiation beam ("antenna beam") that is generated by each antenna directed outwardly to serve a respective sector. Typically, a base station antenna includes one or more phase-controlled arrays of radiating elements, with the radiating elements arranged in one or more vertical columns when the antenna is mounted for use. Herein, "vertical" refers to a direction that is perpendicular to the horizontal plane that is defined by the horizon. Reference will also be made to the azimuth plane, which is a horizontal plane that bisects the base station antenna, and to the elevation plane, which is a plane extending along the boresight pointing direction of the antenna that is perpendicular to the azimuth plane.

A common base station configuration is the "three sector" configuration in which a cell is divided into three 120° sectors in the azimuth plane. A base station antenna is provided for each sector. In a three sector configuration, the antenna beams generated by each base station antenna typically have a Half Power Beamwidth ("HPBW") in the azimuth plane of about 65° so that each antenna beam provides good coverage throughout a 120° sector. Three such base station antennas provide full 360° coverage in the azimuth plane. Typically, each base station antenna will include one or more so-called "linear arrays" of radiating elements that includes a plurality of radiating elements that are arranged in a generally vertically-extending column. Each radiating element may have an azimuth HPBW of approximately 65° so that the antenna beam generated by the linear array will have a HPBW of about 65° in the azimuth plane. By providing a phase-controlled column of radiating elements extending along the elevation plane, the HPBW of the antenna beam in the elevation plane may be narrowed to be significantly less than 65°, with the amount of narrowing increasing with the length of the column in the vertical direction.

As the volume of cellular traffic has grown, cellular operators have added new cellular services in a variety of new frequency bands. When these new services are introduced, the existing "legacy" services typically must be maintained to support legacy mobile devices. In some cases, it may be possible to use linear arrays of so-called "wide-band" or "ultra-wide-band" radiating elements to support service in the new frequency bands. In other cases, however, it may be necessary to deploy additional linear arrays (or multi-column arrays) of radiating elements to support service in the new frequency bands. Due to local zoning ordinances and/or weight and wind loading constraints, there is often a limit as to the number of base station antennas that can be deployed at a given base station. Thus, to reduce the number of antennas, many operators deploy so-called "multiband" base station antennas that include multiple linear arrays of radiating elements that communicate in different frequency bands to support multiple different cellular services.

Additionally, or alternatively, dual-beam antennas (or multi-beam antennas) may be used to reduce the number of antennas on the tower. A key aspect of such multi-beam antennas is the use of a beamforming network (BFN). For example, the antenna 11 of FIGS. 1A and 1B employs a 2×2 BFN 10 having a 3 dB 90° hybrid coupler shown at 12 and forms both beams A and B in azimuth plane at signal ports 14. (2×2 BFN means a BFN creating 2 beams by using 2 columns). The two radiator coupling ports 16 are connected to antenna elements also referred to as radiators, and the two ports 14 are coupled to the phase shifting network, which is providing elevation beam tilt (see FIG. 1B). An antenna may be both multi-beam and multi-band; that is, an antenna may be configured with both multiple linear arrays of radiating elements that communicate in different frequency bands, with at least some of those radiating elements coupled to one or more BFN to provide directionalized beams in the azimuth plane.

However, as discussed in U.S. Pat. No. 9,831,548, which is incorporated by reference, the main drawback of the prior art antenna of FIGS. 1A and 1B is that more than 50% of the radiated power is wasted and directed outside of the desired 60° sector for a 6-sector application, and the azimuth beams are too wide (150°@−10 dB level), creating interference with other sectors. Moreover, the low gain and large backlobe (about −11 dB) are not acceptable for modern systems due to high interference generated by one antenna into other cells.

SUMMARY

In order to reduce large sidelobes that may result from using a base station antenna with increased electronic downtilt, the present disclosure provides base station antennas in which the columns of at least one of the modules are staggered or offset with respect to each other. In some embodiments, a majority of the modules that are present within the base station antenna may include such staggered column arrangements.

According to some aspects of the present disclosure, a multi-beam cellular antenna is provided. The multi-beam cellular antenna may include an antenna array having a plurality of modules, each module comprising at least three columns of radiating elements each having first polarization radiators, wherein the columns of radiating elements of at least one of the modules are staggered with respect to each other; and an antenna feed network configured to couple at least a first input signal and a second input signal to each first polarization radiator of each of the radiating elements included in a first of the plurality of modules.

In some embodiments, the radiating elements of the columns of radiating elements of a majority of the modules are staggered with respect to each other. In some embodiments, the radiating elements of the columns of radiating elements of at least one of the modules are aligned with respect to each other.

A first module of the plurality of modules may include three columns of radiating elements, and wherein a second module of the plurality of modules may include four columns of radiating elements. In some embodiments, the three columns of radiating elements of the first module may each include an equal number of radiating elements. In some embodiments, a first column of radiating elements of the first module may include a number of radiating elements that is less than a number of radiating elements included in a second column of the first module. The antenna feed network may include a 2×3 beamforming network that couples the first and second input signals to the radiating elements of the first module and a 2×4 beamforming network that couples the first and second input signals to the second module. The 2×4 beamforming network may include at least one variable power divider.

The antenna array may be configured to generate a first beam that points in a first direction responsive to the first input signal and to generate a second beam that points in a second direction responsive to the second input signal.

The radiating elements may be cross-polarized radiating elements.

According to some aspects of the present disclosure, a multi-beam cellular antenna is provided. The multi-beam cellular antenna may include a plurality of first modules each having a first number of columns of radiating elements. The radiating elements of the columns of at least one of the first modules may be staggered with respect to each other. The multi-beam cellular antenna may also include a plurality of second modules each having a second number of columns of radiating elements. The radiating elements of the columns of at least one of the second modules may be staggered with respect to each other. The multi-beam cellular antenna may also include an antenna feed network that includes at least one 2×4 beamforming network that couples first and second input signals to the radiating elements of one of the plurality of first modules, and at least one 2×3 beamforming network that couples the first and second input signals to the radiating elements of one of the plurality of second modules.

The radiating elements of the columns of radiating elements of a majority of the first modules may be staggered with respect to each other. The radiating elements of the columns of radiating elements of at least one of the second modules may be aligned with respect to each other. Each first module may include four columns of radiating elements, and each second module of the plurality of modules may include three columns of radiating elements. The 2×4 beamforming network may include at least one variable power divider.

The plurality of first modules and plurality of second modules may be configured to generate a first beam that points in a first direction responsive to the first input signal and may be configured to generate a second beam that points in a second direction responsive to the second input signal.

According to some aspects of the present disclosure, a multi-beam cellular antenna is provided. The multi-beam cellular antenna may include a plurality of first modules each having a first number of columns of radiating elements. The radiating elements of the columns of at least one of the first modules may be staggered with respect to each other. The multi-beam cellular antenna may also include a second module having a second number of columns of radiating elements. The radiating elements of the columns of the second module may be staggered with respect to each other. The multi-beam cellular antenna may also include an antenna feed network that includes at least one 2×4 beamforming network that couples first and second input signals to the radiating elements of one of the plurality of first modules, and at least one 2×3 beamforming network that couples the first and second input signals to the radiating elements of the second module.

A first column of radiating elements of the second module may include a number of radiating elements that is less than a number of radiating elements included in a second column of the second module.

The multi-beam cellular antenna may further include a third module having the second number of columns of radiating elements. The columns of the third module may be staggered with respect to each other. Each column of the third module may include an equal number of radiating elements as the first column of radiating elements of the second module.

DETAILED DESCRIPTION

As discussed in the above-referenced U.S. Pat. No. 9,831,548, a base station antenna that is currently of interest includes a plurality of modules of radiating elements.

Figure 1A:
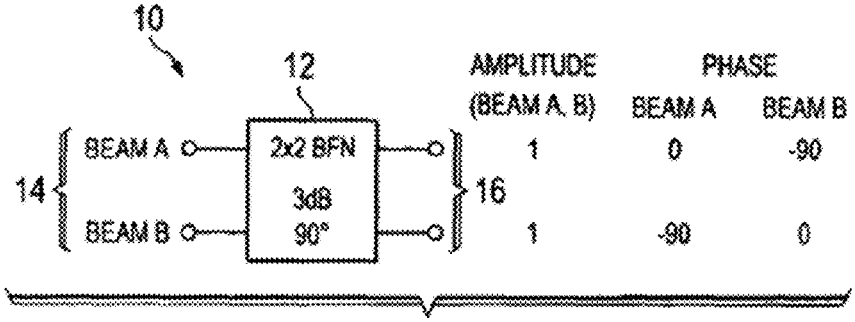
FIG. 1A (PRIOR ART)
FIGS. 1A and 1B schematically show a conventional dual-beam antenna with a conventional 2×2 BFN.
Figure 1B:
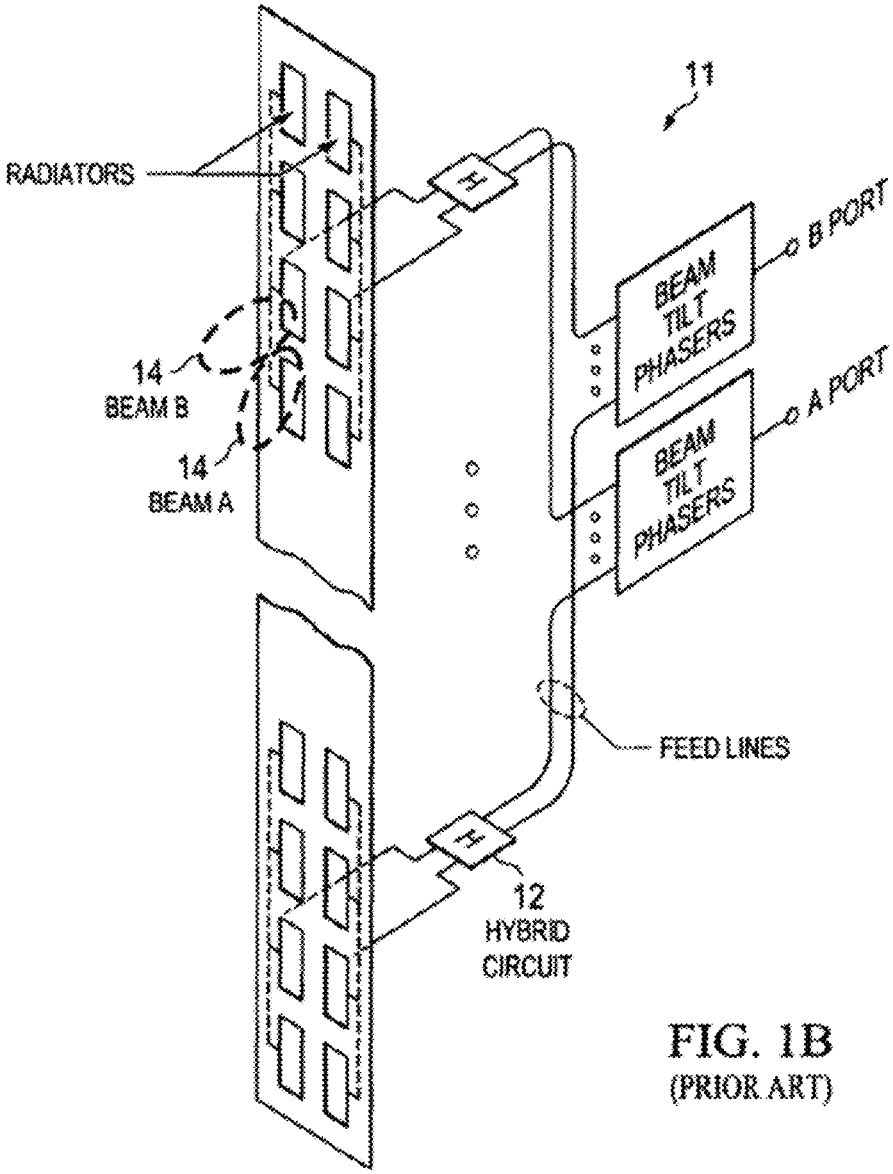
FIG. 1B (PRIOR ART)
Figure 2:
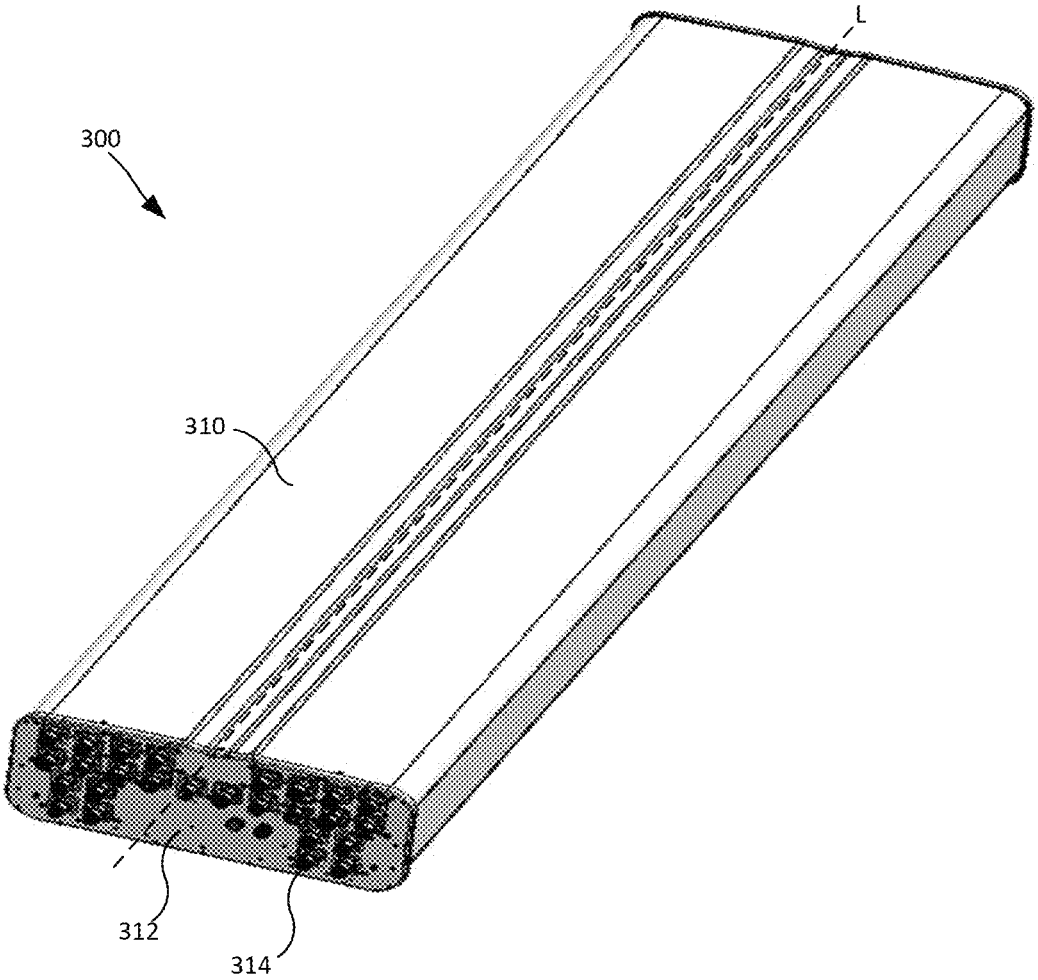
FIG. 2 is a perspective view of a base station antenna.
Figure 3:
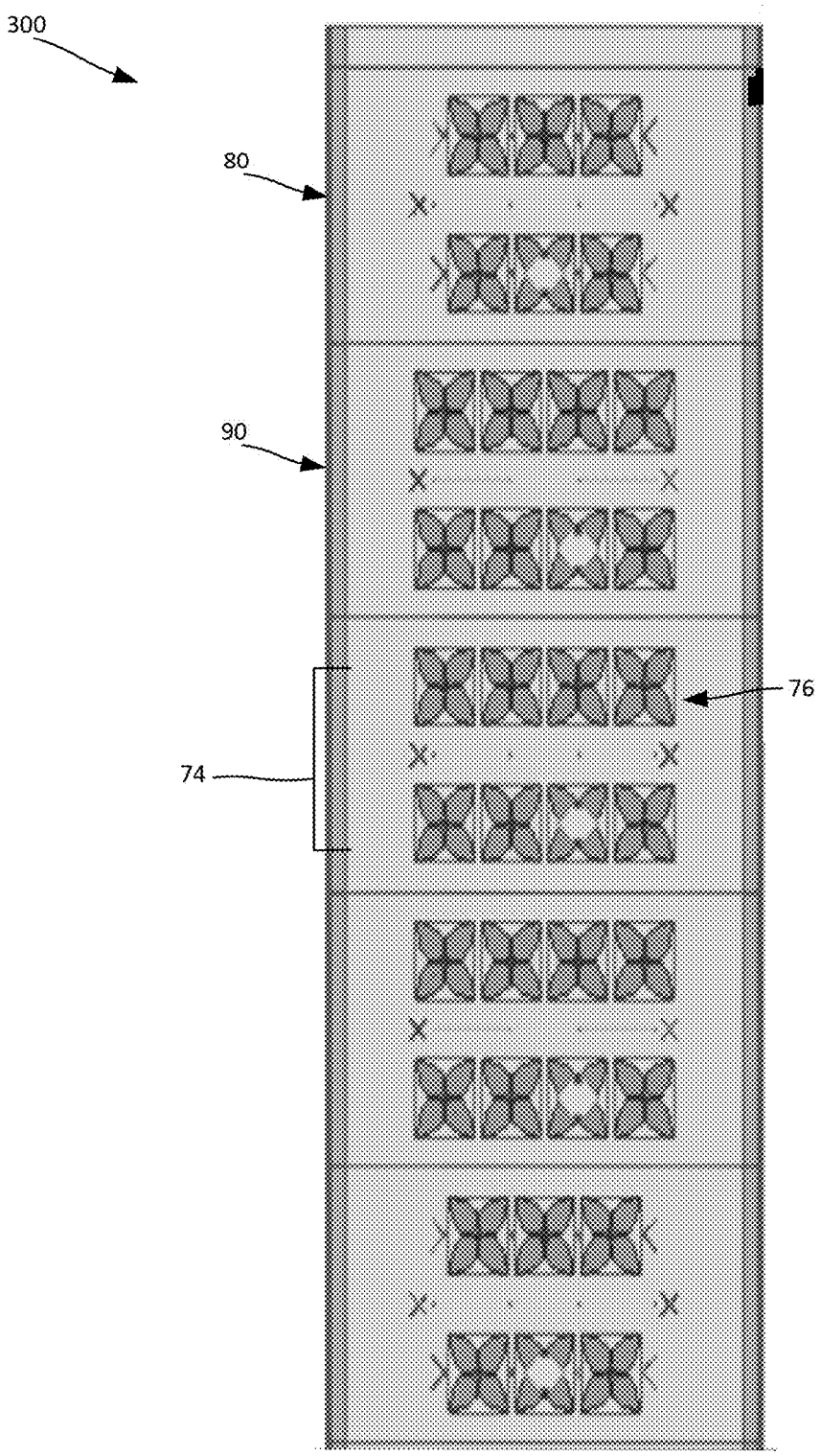
FIG. 3 is a schematic front view of the base station antenna of FIG. 2 with the radome removed that illustrates the arrays of radiating elements included in the antenna.

FIGS. 2 and 3 illustrate a perspective view of a base station antenna 300. FIG. 2 is a perspective view of the base station antenna 300, while FIG. 3 is a front view of the base station antenna 300 with the radome removed that schematically illustrates the modules of radiating elements included in the antenna 300.

As shown in FIG. 2, the base station antenna 300 is an elongated structure that extends along a longitudinal axis L. The base station antenna 300 may have a tubular shape with a generally rectangular cross-section. The antenna 300 includes a radome 310 and a bottom end cap 312. A plurality of RF connectors 314 may be mounted in the bottom end cap 312. The antenna 300 is typically mounted in a vertical configuration (i.e., the longitudinal axis L may be generally perpendicular to a plane defined by the horizon when the antenna 300 is mounted for normal operation).

As seen in FIG. 3, the base station antenna 300 may include one or more modules 80, 90 that each include one or more columns 74 of radiating elements 76. The radiating elements 76 may be radiating elements configured to provide service in one or more than one frequency bands, such as the 1.7-2.7 GHz frequency band, the 3.4-3.8 GHz frequency band, and/or the 5.1-5.8 GHz frequency band. Each of the radiating elements 76 may be a cross-polarized radiating element. The base station antenna 300 of FIGS. 2-3 includes two three-column modules 80 and three four-column modules 90, though the number of modules and the number of columns per module may vary in different embodiments. Moreover, although FIG. 3 shows that each column 74 of radiators 76 of both the three-column modules 80 and the four-column modules 90 has two radiators 76, in some applications a different number of radiators 76 may be present in each of the columns 74 of a module 80, 90.

Each three-column antenna module 80 of the base station antenna 300 of FIGS. 2 and 3 is fed by first and second 2×3 BFNs. The first 2×3 BFN may form antenna beams for a first polarization, e.g., a slant −45° polarization, and the second 2×3 BFN may be configured to form antenna beams for a second polarization, e.g., a +45° polarization. Similarly, each four-column module 90 may be fed by first and second 2×4 BFNs, with the first 2×4 BFN configured to form antenna beams for a first polarization, e.g., a slant −45° polarization, and the second 2×4 BFN configured to form antenna beams for a second polarization, e.g., a +45° polarization. The 2×3 and 2×4 BFNs are not shown in FIG. 3, but examples of each are shown in incorporated U.S. Pat. No. 9,831,548.

Figure 10A:
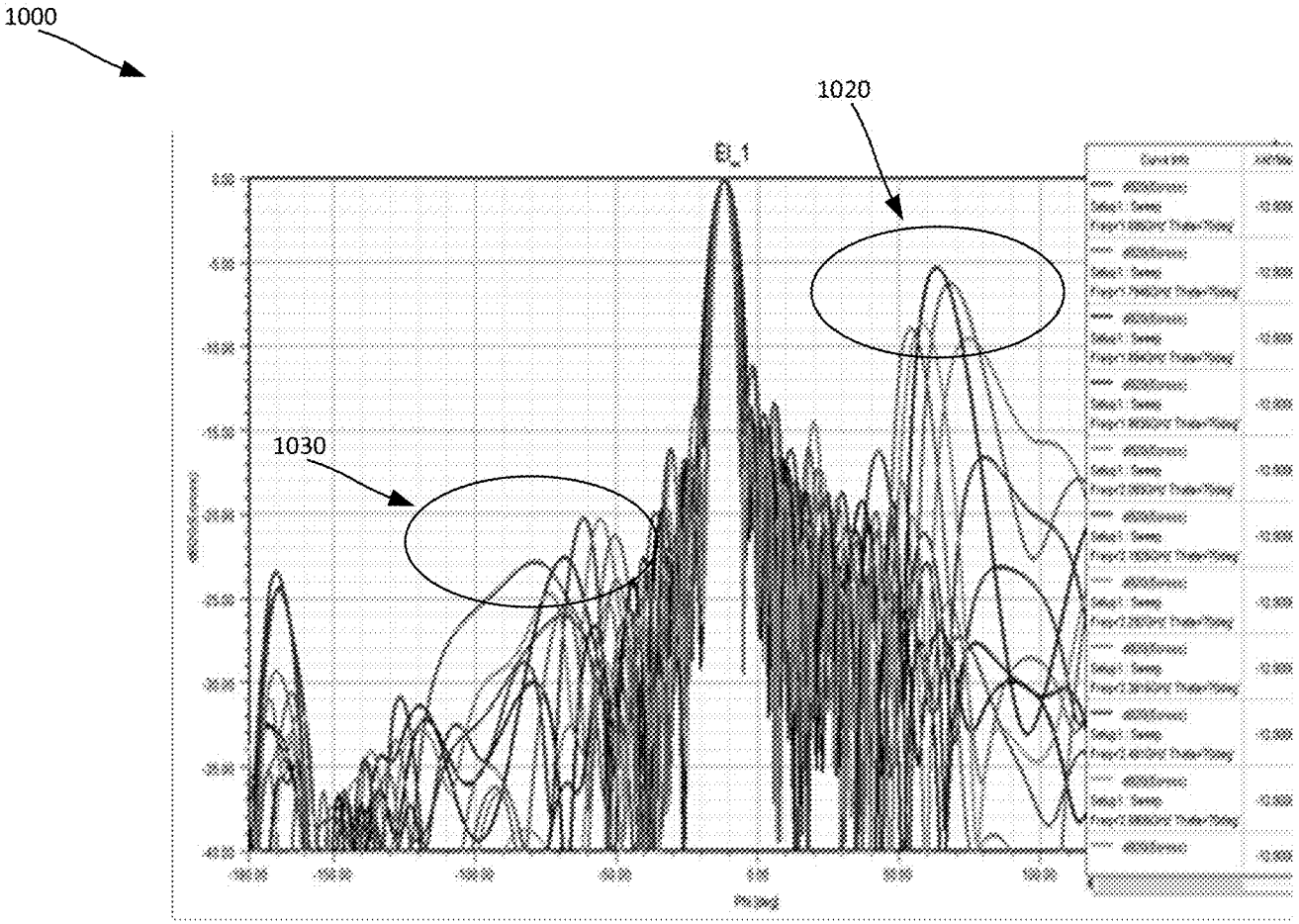
FIG. 10A is a radiation elevation pattern of the base station antenna of FIG. 2.

Although the incorporated U.S. Pat. No. 9,831,548 discusses that the base station antenna 300 results in radiation patterns having low sidelobes in both the azimuth and elevation planes, the present disclosure results from the recognition that a large sidelobe may be present when there is a large degree of electronic downtilt applied to the antenna beams, e.g., from phase shifting. Increasing electronic downtilt is frequently desirable as it may be used to reduce the size of a cell when a new adjacent cell is added by a network operator. One way of increasing capacity is to use a larger number of smaller cells. FIG. 10A shows an elevation pattern 1000 for the base station antenna 300 of FIGS. 2-3 for one polarization at the large degree of downtilt, along with the discovered sidelobe 1020. It may also be seen that there is an unequal balance in the sidelobes between the large sidelobe 1020 and a smaller sidelobe 1030 on the other side of the main lobe.

In order to reduce large sidelobes that may result from using a base station antenna with increased electronic downtilt, the present disclosure provides base station antennas in which the columns of at least one of the modules 80, 90 are staggered or offset with respect to each other. In some embodiments, a majority of the modules 80, 90 that are present within the base station antenna may include such staggered column arrangements.

The presence of staggered column arrangements may help to equalize RF energy on both sides of the main lobe. Although this may result in an increase in a lower sidelobe (e.g., the low sidelobe 1030), there is an overall positive result and improvement in performance of antennas with such arrangements resulting from the reduction in a higher sidelobe (e.g., the high sidelobe 1020).

Figure 4:
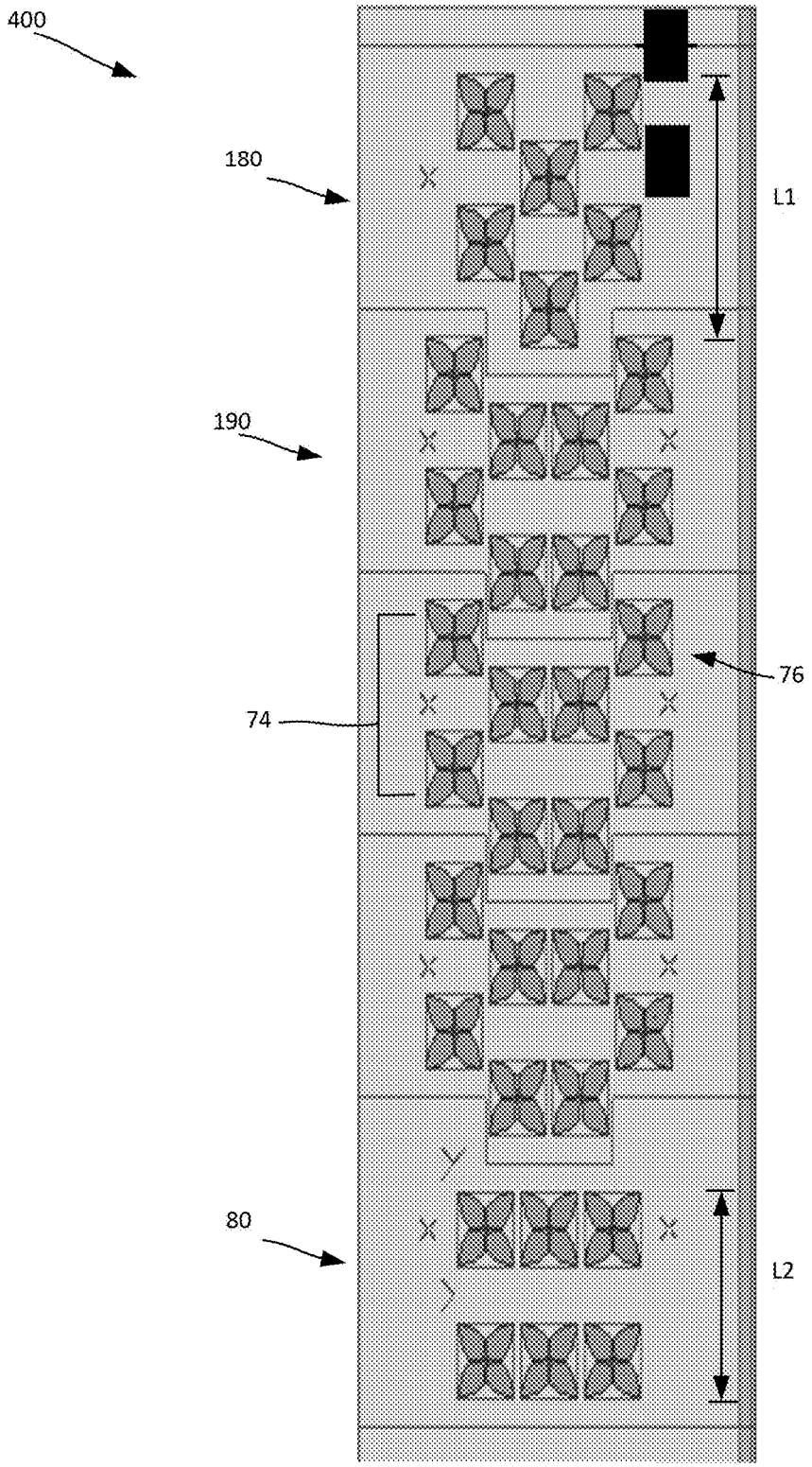
FIG. 4 is a schematic front view of a base station antenna according to aspects of the present disclosure having modules with staggered column arrangements that illustrates the arrays of radiating elements included in the antenna.

FIG. 4 is a front view of a base station antenna 400 with the radome removed that schematically illustrates the modules of radiating elements included in the antenna 400. As with the base station antenna 300 of FIG. 2, the base station antenna 400 is an elongated structure that extends along a longitudinal axis with a radome, bottom end cap, and RF connectors that are similar to those discussed with respect to FIG. 2. For brevity, discussion of these components is not duplicated herein.

As seen in FIG. 4, one or more modules 180, 190 comprising staggered columns 74 of radiating elements 76 may be provided in the base station antenna 400. The radiating elements 76 may be radiating elements configured to provide service in one or more than one frequency bands, such as the 1.7-2.7 GHz frequency band, the 3.4-3.8 GHz frequency band, and/or the 5.1-5.8 GHz frequency band. Each of the radiating elements 76 may be a cross-polarized radiating element.

The base station antenna 400 of FIG. 4 includes one staggered three-column module 180, and three staggered four-column modules 190 and one non-staggered three-column module 80. However, the number of staggered modules and the number of columns per staggered module may vary in different embodiments. Moreover, although FIG. 4 shows that each column 74 of radiators 76 of both the three-column staggered module 180 and the four-column staggered modules 190 has two radiators 76, in some applications a different number of radiators 76 may be present in each of columns 74 of a staggered module 180, 190.

In some embodiments, the base station antenna 400 may include one or more than one non-staggered three-column module 80. In some embodiments, the base station antenna 400 may include one or more than one non-staggered four-column module 90. As can be seen from comparing a length L1 parallel to the longitudinal axis L of the staggered three-column module 180 with a length L2 parallel to the same axis of the non-staggered or aligned three-column module 80, the length of a staggered module may be greater than a non-staggered module. In order to size the base station antenna 400 to satisfy, for example, local zoning ordinances and/or weight and wind loading constraints, a non-staggered module may be used on either or both ends of the base station antenna 400 to reduce the overall length thereof.

Each staggered three-column antenna module 180 of the base station antenna 400 of FIG. 4 is fed by first and second 2×3 BFNs. The first 2×3 BFN may form antenna beams for a first polarization, e.g., a slant −45° polarization, and the second 2×3 BFN may be configured to form antenna beams for a second polarization, e.g., a +45° polarization. Similarly, each staggered four-column module 190 may be fed by first and second 2×4 BFNs, with the first 2×4 BFN configured to form antenna beams for a first polarization, e.g., a slant −45° polarization, and the second 2×4 BFN configured to form antenna beams for a second polarization, e.g., a +45° polarization. The 2×3 and 2×4 BFNs are not shown in FIG. 4, but are illustrated respectively in FIGS. 7 and 8 and described in greater detail below.

Figure 5:
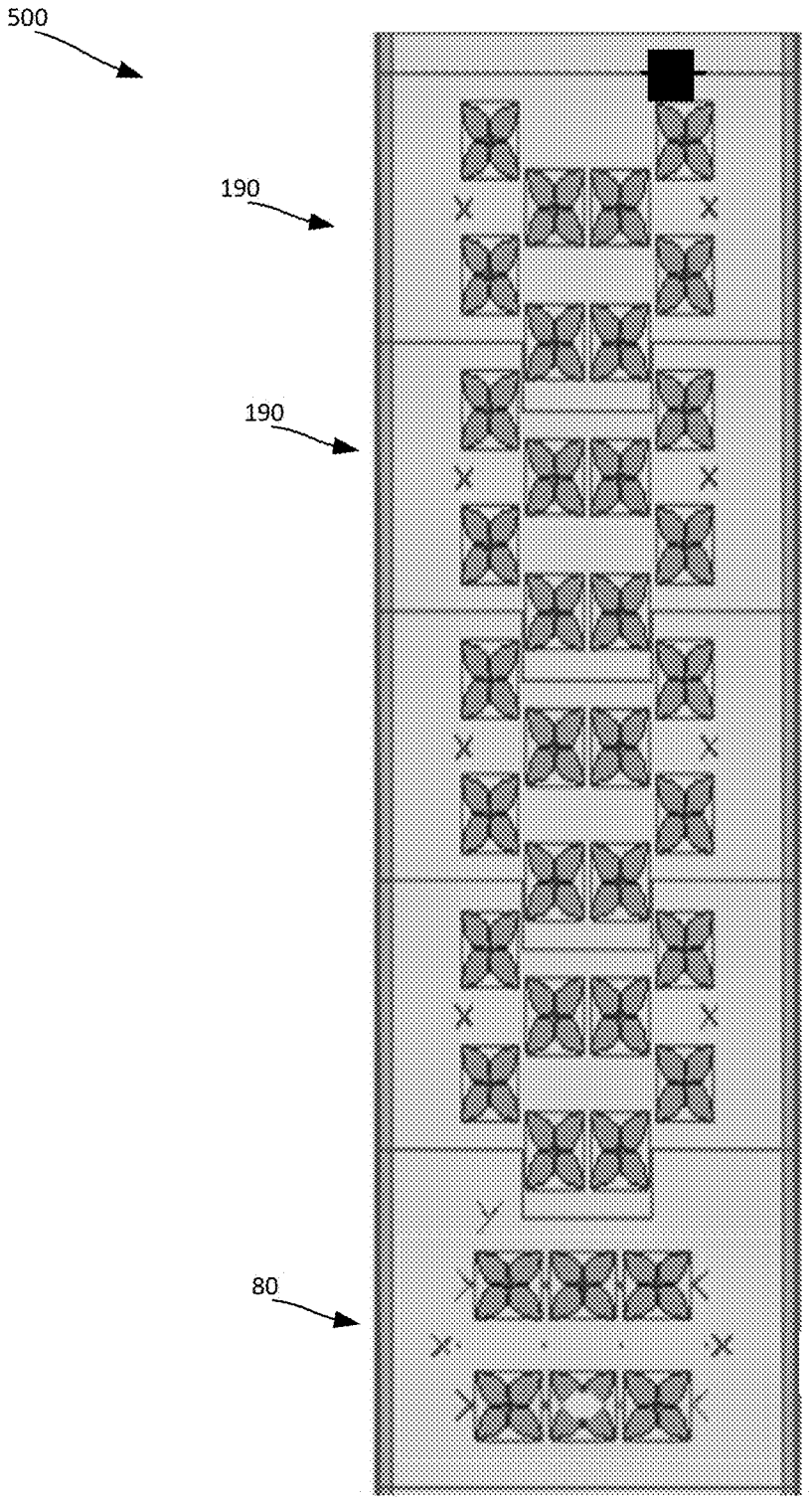
FIG. 5 is a schematic front view of a base station antenna according to aspects of the present disclosure having modules with staggered column arrangements that illustrates the arrays of radiating elements included in the antenna.

FIG. 5 is a front view of a base station antenna 500 with the radome removed that schematically illustrates the modules of radiating elements included in the antenna 500. The base station antenna 500 of FIG. 5 is similar to the base station antenna 400 of FIG. 4, except that the base station antenna 500 of FIG. 5 omits the staggered three-column module 180 of FIG. 4 in favor of an additional staggered four-column module 190. Each module 80, 190 of the base station antenna 500 of FIG. 5 is fed by a respective pair of either 2×3 or 2×4 BFNs which are illustrated respectively in FIGS. 7 and 8 and described in greater detail below.

Figure 6:
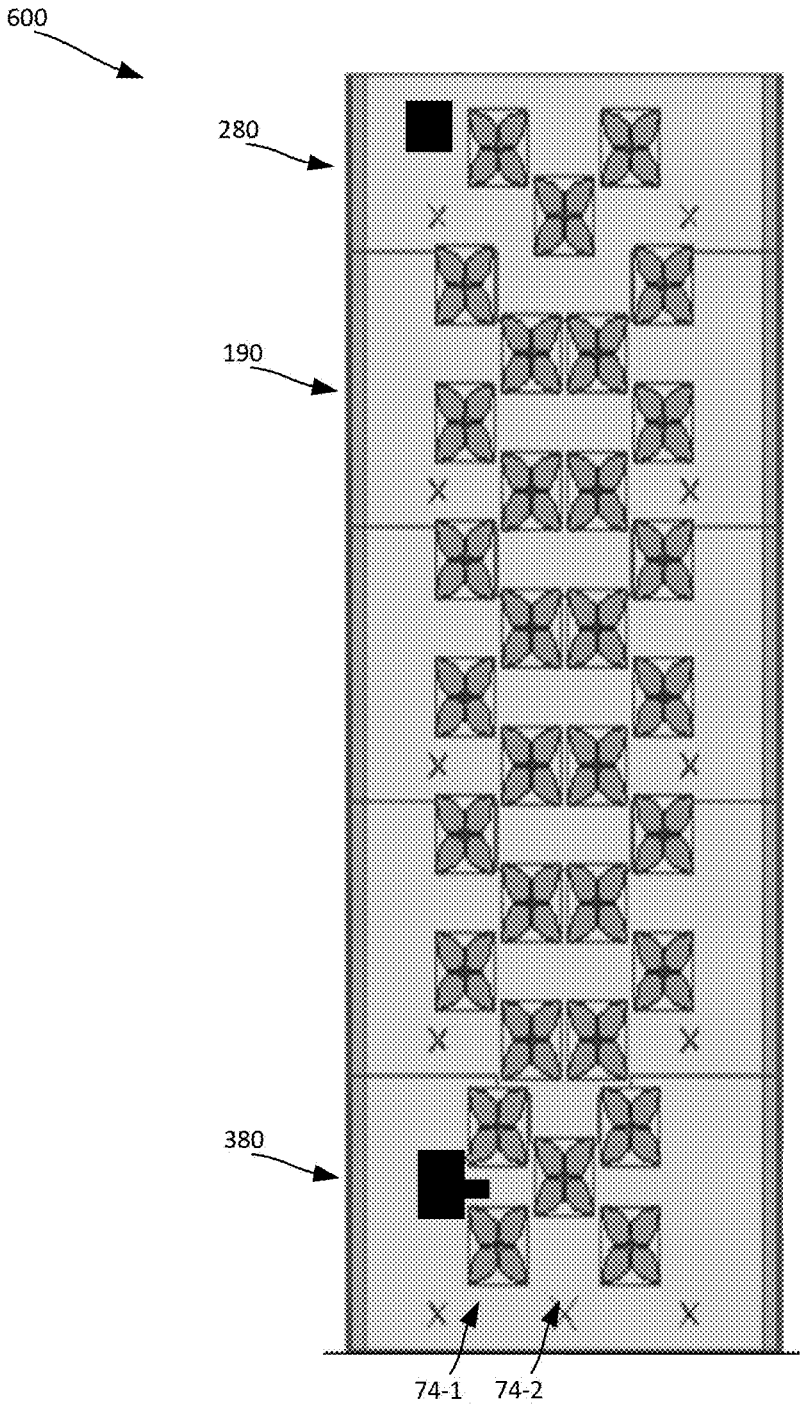
FIG. 6 is a schematic front view of a base station antenna according to aspects of the present disclosure having modules with staggered column arrangements that illustrates the arrays of radiating elements included in the antenna.

FIG. 6 is a front view of a base station antenna 600 with the radome removed that schematically illustrates the modules of radiating elements included in the antenna 600. The base station antenna 600 of FIG. 6 is similar to the base station antennas 400 of FIG. 4 and 500 of FIG. 5, except that the base station antenna 600 of FIG. 6 includes a staggered three-column module 280 at one end of the base station antenna 600, with one radiating element 76 per column 74. Additionally, a staggered three-column module 380 is provided at the opposite end of the base station antenna 600 that includes at least one column 74-2 with a different number of radiating elements 76 than a different column (e.g. column 74-1) of the same module 380. The result is that there are five radiating elements 76 in the staggered three-column module 380 of FIG. 6, as opposed to six radiating elements 76 in the staggered three-column module 180 of FIG. 4. Each module 280, 380, and 190 of the base station antenna 600 of FIG. 6 is fed by a respective pair of either 2×3 or 2×4 BFNs which are illustrated respectively in FIGS. 7 and 8 and described in greater detail below.

Figure 7:
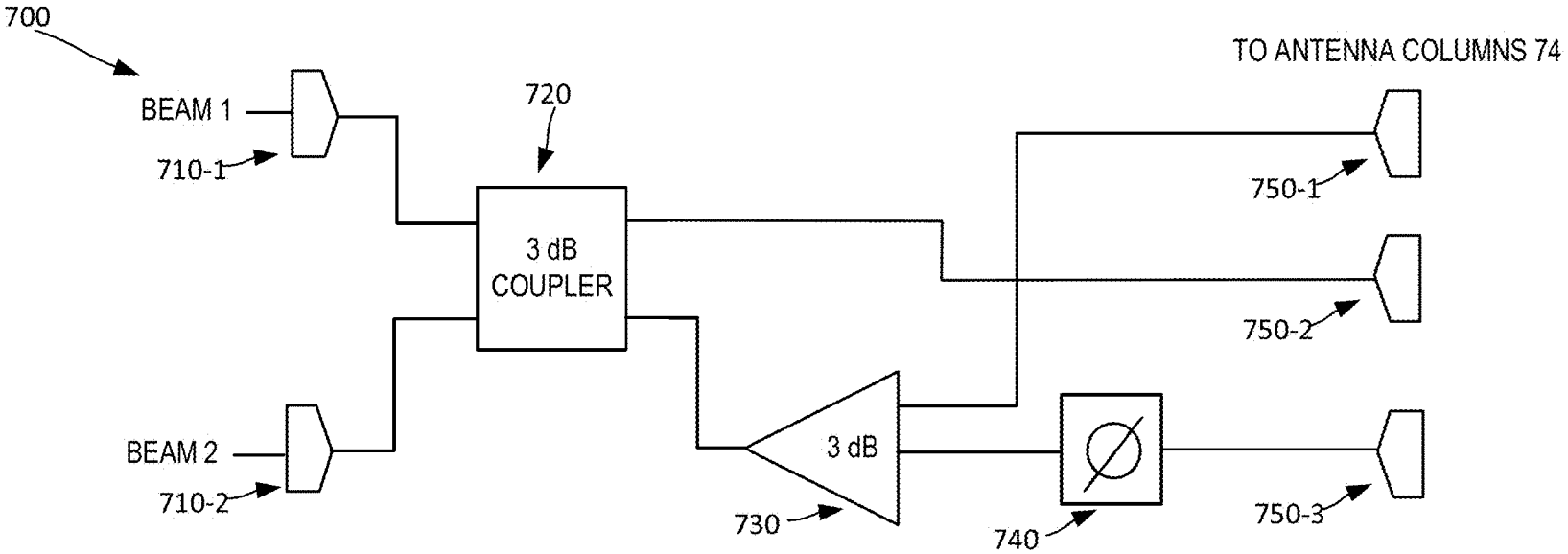
FIG. 7 is a block diagram of a 2×3 beam forming network configured for use with modules of base station antennas having staggered column arrangements such as those illustrated in FIGS. 4-6.

FIG. 7 is a block diagram of a 2×3 beam forming network 700 configured for use with modules of base station antennas having staggered column arrangements such as those illustrated in FIGS. 4-6. The 2×3 beam forming network 700 of FIG. 7 is configured to form 2 antenna beams with 3 staggered columns of radiators for signals received at signal ports 710-1 and 710-2. A 90° hybrid coupler 720 is provided, which may be a 3 dB coupler. In some embodiments, the splitting coefficient of the 90° hybrid coupler 720 may be varied, and different amplitude distributions of the beams can be obtained for column coupling ports 750-1, 750-2, and 750-3: from uniform (1-1-1) to heavy tapered (0.4-1-0.4). With equal splitting (3 dB coupler) 0.7-1-0.7 amplitudes are provided. Additionally, an equal splitter 730 is provided between one of the ports of the 90° hybrid coupler 720 and two of the column coupling ports (in this case, column coupling ports 750-1 and 750-3). In some embodiments, the splitter 730 may be a Wilkinson divider with a 180° Shiffman phase shifter. However, equal phase dividers can be used. Further, 180° phase shifting of signals transmitted to one of the column coupling ports (in this case, column coupling port 750-3) is performed by a dipole element with 180° rotation 740. In some embodiments, the beam forming network 700 may include or implement a Butler matrix.

Figure 8:
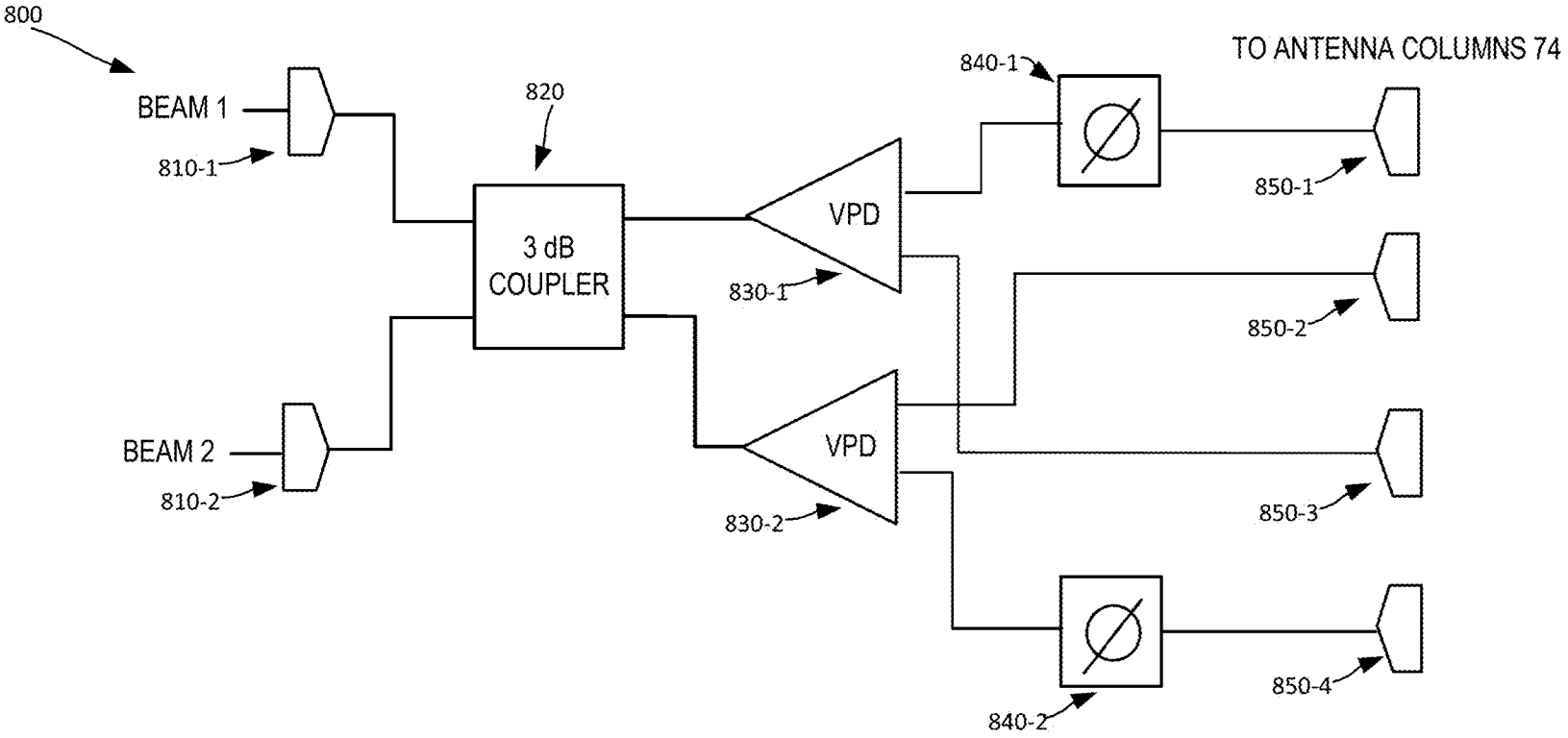
FIG. 8 is a block diagram of a 2×4 beam forming network configured for use with modules of base station antennas having staggered column arrangements such as those illustrated in FIGS. 4-6.

FIG. 8 is a block diagram of a 2×4 beam forming network 800 configured for use with modules of base station antennas having staggered column arrangements such as those illustrated in FIGS. 4-6. The 2×4 beam forming network 800 of FIG. 8, is configured to form 2 antenna beams with 4 staggered columns of radiators for signals received at signal ports 810-1 and 810-2. A 90° hybrid coupler 820 is provided, which may be a 3 dB coupler. Two variable power dividers 830-1 and 830-2 are provided between two of the ports of the 90° hybrid coupler 820 and the column coupling ports 850-1 to 850-4). Further, 180° phase shifting of signals transmitted to two of the column coupling ports (in this case, column coupling ports 850-1 and 850-4) is performed by respective dipole elements with 180° rotation 840-1, 840-2 arranged between the column coupling ports and the variable power dividers 830-1, 830-2. In some embodiments, the beam forming network 800 may include or implement a Butler matrix.

Figure 9:
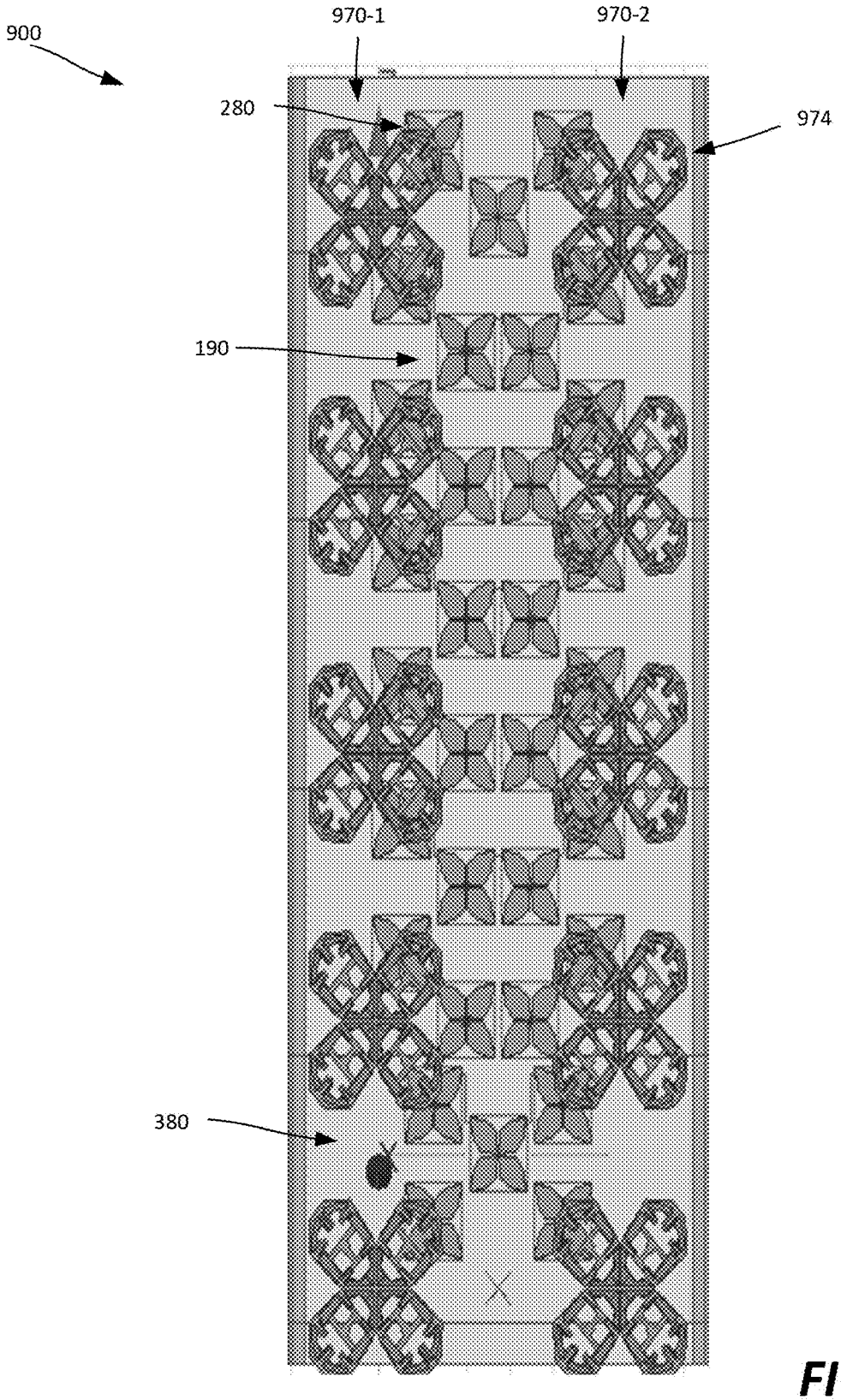
FIG. 9 is a schematic front view of a multi-band base station antenna having modules with staggered column arrangements that illustrates the arrays of radiating elements included in the antenna.

FIG. 9 is a front view of a multi-band base station antenna 900 with a radome removed that schematically illustrates the modules of radiating elements included in the antenna 900. The base station antenna 900 of FIG. 9 is similar to the base station antenna 600 of FIG. 6, except that first and second columns 970-1, 970-2 of radiating elements 974 are also shown. The radiating elements 974 may be used to provide service in a different frequency band than the radiating elements 74 of the modules 180, 190, 280, 380 shown herein. For example, the radiating elements 974 may be used to provide service in some or all of the 617-960 MHz frequency band. The arrangement of the multi-band base station antenna 900 is provided as an example, and the radiating elements 974 may be used in the base station antenna 500 of FIG. 5 without limitation.

Additionally, or alternatively, in some embodiments at least some of the radiating elements 76 described herein and the modules or base station antennas including such radiating elements 76 may be configured to provide a multi-input-multi-output (MIMO) array of "high-band" radiating elements that operate in, for example, some or all of the 1.7-2.7 GHz frequency band, the 3.4-3.8 GHz frequency band, or the 5.1-5.8 GHz frequency band. Massive MIMO arrays typically have at least four columns of radiating elements, and as many as thirty-two columns of radiating elements. In some embodiments, two or more base station antennas 400 of FIG. 4, base station antennas 500 of FIG. 5, and/or base station antennas 600 of FIG. 6 may be vertically stacked to provide a MIMO array of a desired size.

Figure 10B:
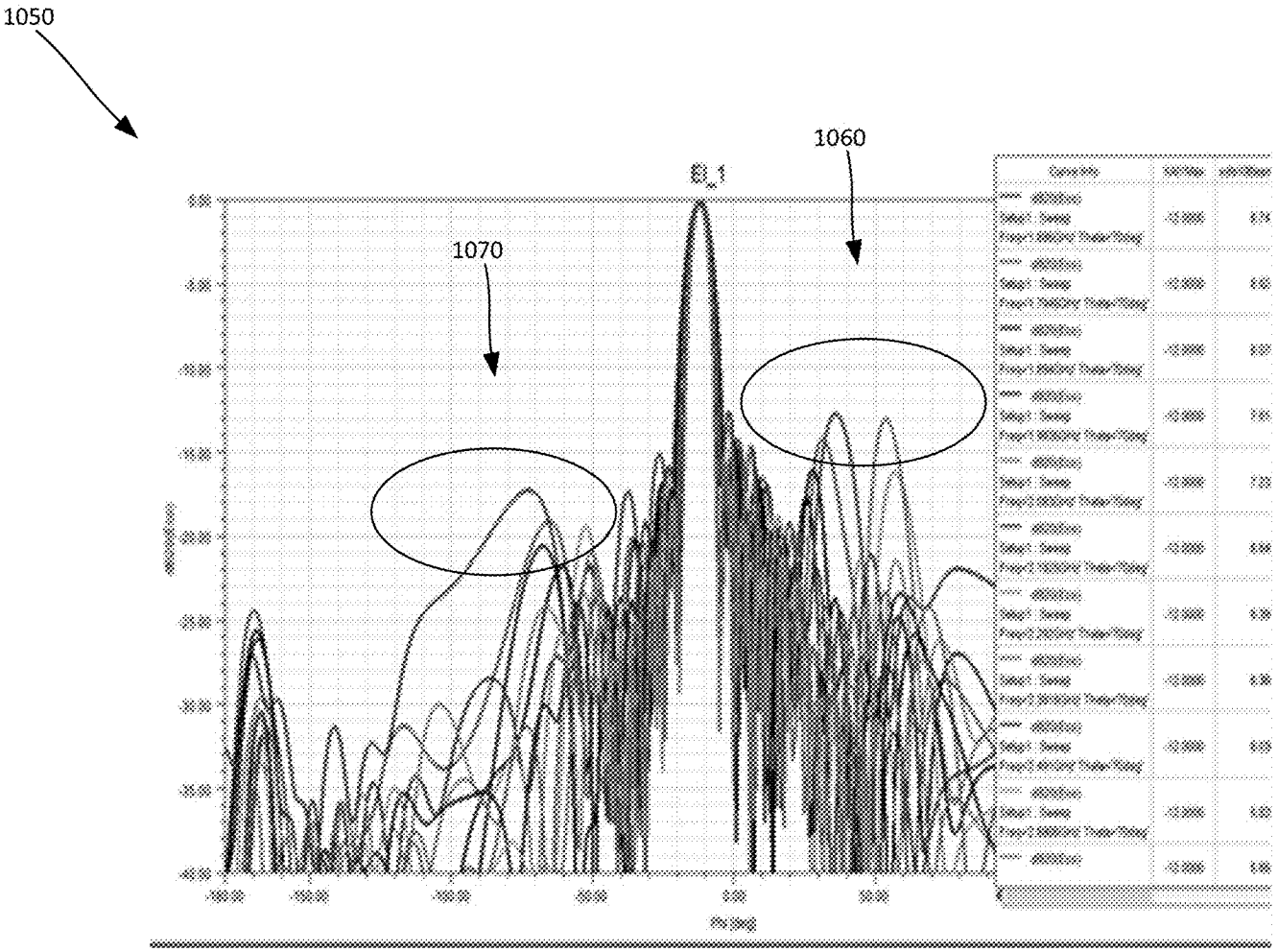
FIG. 10B is a radiation elevation pattern of the base station antenna of FIG. 4.

FIG. 10B shows an elevation pattern 1050 for the base station antenna 400 of FIG. 4 for one polarization at the same degree of electronic downtilt as the elevation pattern 1000 of FIG. 10A. It may also be seen that there is a more equal balance of RF energy between a right sidelobe 1060 and a left sidelobe 1070 and that the highest sidelobe level is lower than the highest sidelobe levels in FIG. 10A.

While the discussion above focuses on radiating elements, it will be appreciated that the techniques discussed above can be used with radiating elements that operate in any appropriate frequency band.

Aspects of the present disclosure have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, operations, elements, and/or components, but do not preclude the presence or addition of one or more other features, operations, elements, components, and/or groups thereof.

Aspects and elements of all of the embodiments disclosed above can be combined in any way and/or combination with aspects or elements of other embodiments to provide a plurality of additional embodiments.

What is claimed is:

1. A multi-beam cellular antenna, comprising:

an antenna array having a plurality of modules, each module comprising at least three columns of radiating elements each having first polarization radiators, wherein the columns of radiating elements of at least one of the modules are staggered with respect to each other; and an antenna feed network configured to couple at least a first input signal and a second input signal to each first polarization radiator of each of the radiating elements included in a first of the plurality of modules.

2. The multi-beam cellular antenna of claim 1, wherein the radiating elements of the columns of radiating elements of a majority of the modules are staggered with respect to each other.

3. The multi-beam cellular antenna of claim 1, wherein the radiating elements of the columns of radiating elements of at least one of the modules are aligned with respect to each other.

4. The multi-beam cellular antenna of claim 1, wherein a first module of the plurality of modules comprises three columns of radiating elements, and wherein a second module of the plurality of modules comprises four columns of radiating elements.

5. The multi-beam cellular antenna of claim 4, wherein the three columns of radiating elements of the first module each include an equal number of radiating elements.

6. The multi-beam cellular antenna of claim 4, wherein a first column of radiating elements of the first module includes a number of radiating elements that is less than a number of radiating elements included in a second column of the first module.

7. The multi-beam cellular antenna of claim 4, wherein the antenna feed network comprises a 2×3 beamforming network that couples the first and second input signals to the radiating elements of the first module and a 2×4 beamforming network that couples the first and second input signals to the second module.

8. The multi-beam cellular antenna of claim 7, wherein the 2×4 beamforming network comprises at least one variable power divider.

9. The multi-beam cellular antenna of claim 1, wherein the antenna array is configured to generate a first beam that points in a first direction responsive to the first input signal and to generate a second beam that points in a second direction responsive to the second input signal.

10. The multi-beam cellular antenna of claim 1, wherein the radiating elements are cross-polarized.

11. A multi-beam cellular antenna, comprising:

a plurality of first modules each comprising a first number of columns of radiating elements, wherein the radiating elements of the columns of at least one of the first modules are staggered with respect to each other;

a plurality of second modules each comprising a second number of columns of radiating elements, wherein the radiating elements of the columns of at least one of the second modules are staggered with respect to each other; and an antenna feed network comprising at least one 2×4 beamforming network that couples first and second input signals to the radiating elements of one of the plurality of first modules, and at least one 2×3 beamforming network that couples the first and second input signals to the radiating elements of one of the plurality of second modules.

12. The multi-beam cellular antenna of claim 11, wherein the radiating elements of the columns of radiating elements of a majority of the first modules are staggered with respect to each other.

13. The multi-beam cellular antenna of claim 11, wherein the radiating elements of the columns of radiating elements of at least one of the second modules are aligned with respect to each other.

14. The multi-beam cellular antenna of claim 11, wherein each first module comprises four columns of radiating elements, and wherein each second module comprises three columns of radiating elements.

15. The multi-beam cellular antenna of claim 11, wherein the 2×4 beamforming network comprises at least one variable power divider.

16. The multi-beam cellular antenna of claim 11, wherein the plurality of first modules and plurality of second modules are configured to generate a first beam that points in a first direction responsive to the first input signal and to generate a second beam that points in a second direction responsive to the second input signal.

17. A multi-beam cellular antenna, comprising:

a plurality of first modules each comprising a first number of columns of radiating elements, wherein the radiating elements of the columns of at least one of the first modules are staggered with respect to each other;

a second module comprising a second number of columns of radiating elements, wherein the radiating elements of the columns of the second module are staggered with respect to each other; and an antenna feed network comprising at least one 2×4 beamforming network that couples first and second input signals to the radiating elements of one of the plurality of first modules, and at least one 2×3 beamforming network that couples the first and second input signals to the radiating elements of the second module.

18. The multi-beam cellular antenna of claim 17, wherein a first column of radiating elements of the second module includes a number of radiating elements that is less than a number of radiating elements included in a second column of the second module.

19. The multi-beam cellular antenna of claim 18, further comprising a third module comprising the second number of columns of radiating elements, wherein columns of the third module are staggered with respect to each other.

20. The multi-beam cellular antenna of claim 19, wherein each column of the third module comprises an equal number of radiating elements as the first column of radiating elements of the second module.

* * * * *